US005588862A

United States Patent [19]

Perkins et al.

[11] Patent Number: 5,588,862

[45] Date of Patent: Dec. 31, 1996

[54] LOCKING MECHANISM

[76] Inventors: Richard W. Perkins, 13800 Valerio St., Van Nuys, Calif. 91405; Bradley L. Read, 3905 Division St., Los Angeles, Calif. 90065

[21] Appl. No.: 364,295

[22] Filed: Dec. 14, 1994

[51] Int. Cl.[6] ..... H01R 4/50

[52] U.S. Cl. ..... 439/347; 439/346

[58] Field of Search ..... 439/345, 346, 439/347, 324, 350, 352, 353, 217, 222, 372

[56] References Cited

U.S. PATENT DOCUMENTS

| | | | |
|---|---|---|---|
| 3,489,989 | 1/1970 | Robaczewski | 439/347 |
| 4,085,991 | 4/1978 | Marshall et al. | 439/346 |
| 4,136,919 | 1/1979 | Howard et al. | 439/347 |
| 5,352,132 | 10/1994 | O'Keefe et al. | 439/346 |

*Primary Examiner*—Hien D. Vu

[57] ABSTRACT

A locking mechanism that includes a plurality of female pins that can slide into the locking apertures of corresponding male pins, to secure a male connector to a female connector. The female pins are located within corresponding alignment apertures in the female connector and are oriented to be essentially perpendicular to the longitudinal axis of the apertures. The alignment apertures receive the male pins which have cam surfaces that engage the female pins and move the female pins from the first position to the second position. The male pins are inserted into the alignment apertures until the female pins are aligned with the locking apertures, wherein the female pins slide into the locking apertures and interlock the connectors. The female pins extend through the entire length of the locking apertures to effectively double the shear strength of the locking mechanism. The female pins are connected to a handle by a chassis that can move between a first position and a second position. To disengage the connectors, the handle can be depressed to push the female pins out of the locking apertures.

6 Claims, 3 Drawing Sheets

FIG. 4
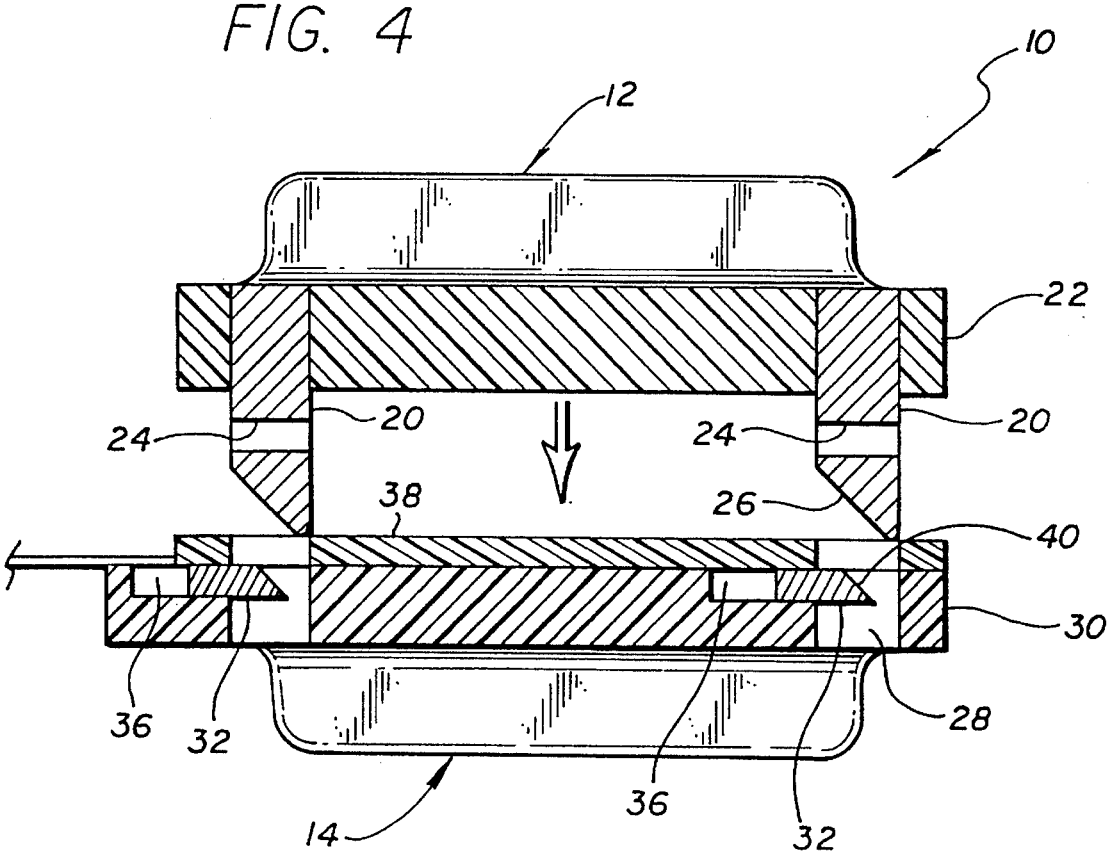
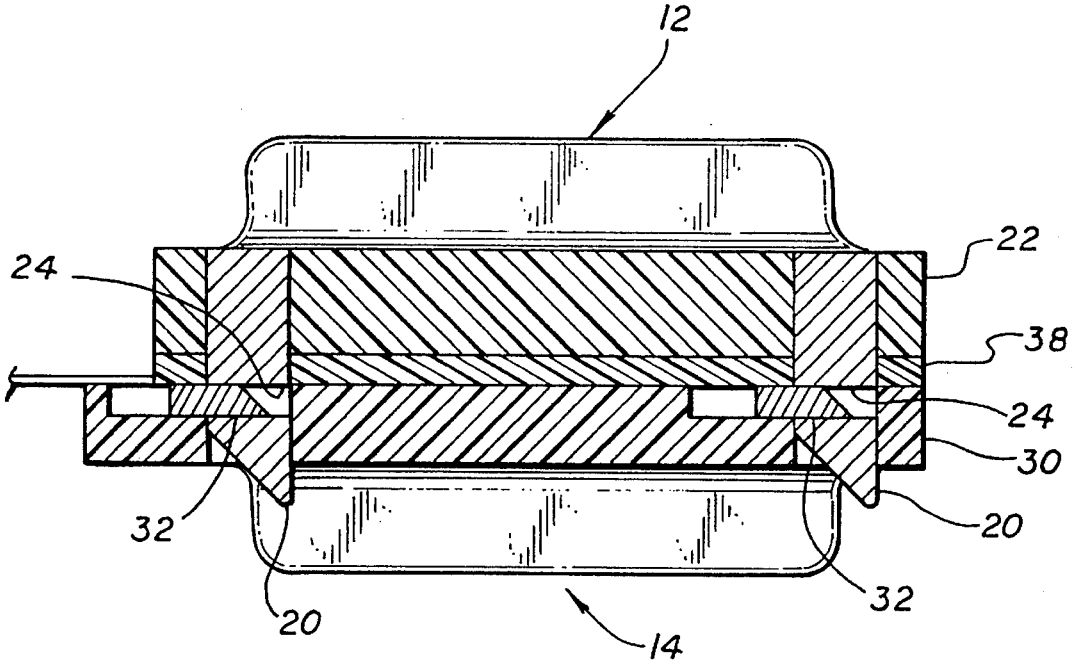
FIG. 5

LOCKING MECHANISM

BACKGROUND OF THE INVENTION

1. Field of the Invention

The present invention relates to a locking mechanism, in particular a locking mechanism for an electrical connector.

2. Description of Related Art

Electrical connectors are typically comprised of male and female receptacles that each contain a plurality of electrical contacts that are mated together. Electrical connectors can be subjected to shock or vibrational forces that separate the contacts. For this reason, many electrical connectors have some type of fastening means to maintain the receptacles in the mated position.

One type of electrical connector fastening means, is a looped shaped spring clip that is pressed into a corresponding notch in the housing of the opposite receptacle. The clip is typically rotated and snapped into place after the connectors are mated together. Spring clips are relatively fragile and are susceptible to failure at high shock or vibration loads.

Another common type of connector fastener is a screw assembly that includes a pair of screws mounted to one of the receptacles, that are screwed into corresponding threaded apertures located in the other mating receptacle. Although more rugged than a spring clip fastener, the screws increase the amount of time required to mate and unplug the connector. Additionally, threaded fasteners are still susceptible to failure under relatively high shock loads. It would be desirable to have a locking mechanism that was strong and can be readily engaged and disengaged.

SUMMARY OF THE INVENTION

The present invention is a locking mechanism that includes a plurality of female pins that can slide into the locking apertures of corresponding male pins, to secure a male connector to a female connector. The female pins are located within corresponding alignment apertures in the female connector and are oriented to be essentially perpendicular to the longitudinal axis of the apertures. The alignment apertures receive the male pins which have cam surfaces that engage the female pins and move the female pins from the first position to the second position. The male pins are inserted into the alignment apertures until the female pins are aligned with the locking apertures, wherein the female pins slide into the locking apertures and interlock the connectors. The female pins extend through the entire length of the locking apertures to effectively double the shear strength of the locking mechanism. The female pins are connected to a handle by a chassis that can move between a first position and a second position. To disengage the connectors, the handle can be depressed to push the female pins out of the locking apertures. The handle is typically coupled to a spring that biases the female pins back to the first position. The male and female connectors may have a wave guide or electrical contacts that are mated together when the female pins become locked with the male pins.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 4 is a cross-sectional view of the connector before the male connector member is mated with the female connector member;

FIG. 5 is a cross-sectional view similar to FIG. 4 showing the connector in a mated position;

DETAILED DESCRIPTION OF THE INVENTION

Figure 1:
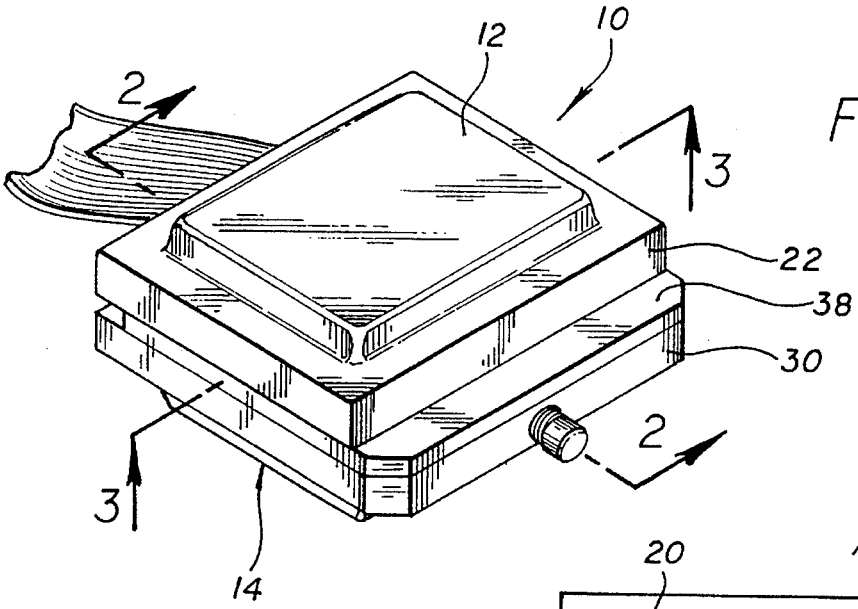
FIG. 1 is a perspective view of an electrical connector of the present invention.
Figure 3:
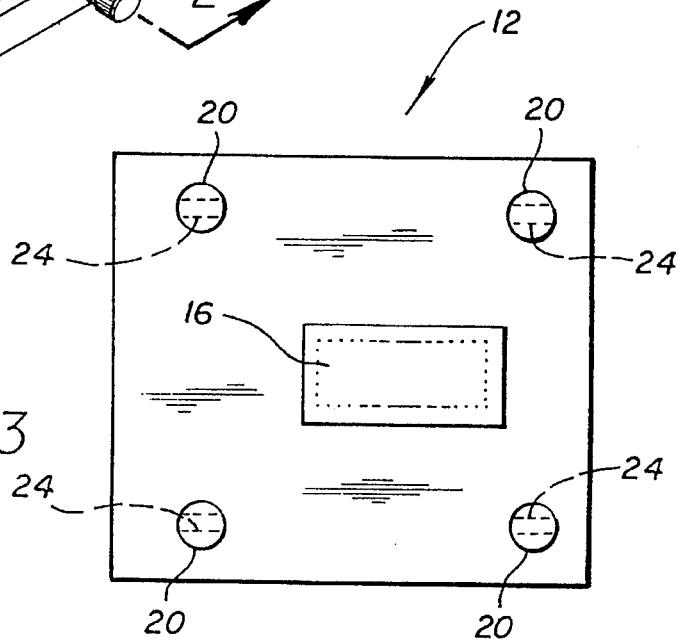
FIG. 3 is a bottom view of the male connector member of the electrical connector.
Figure 2:
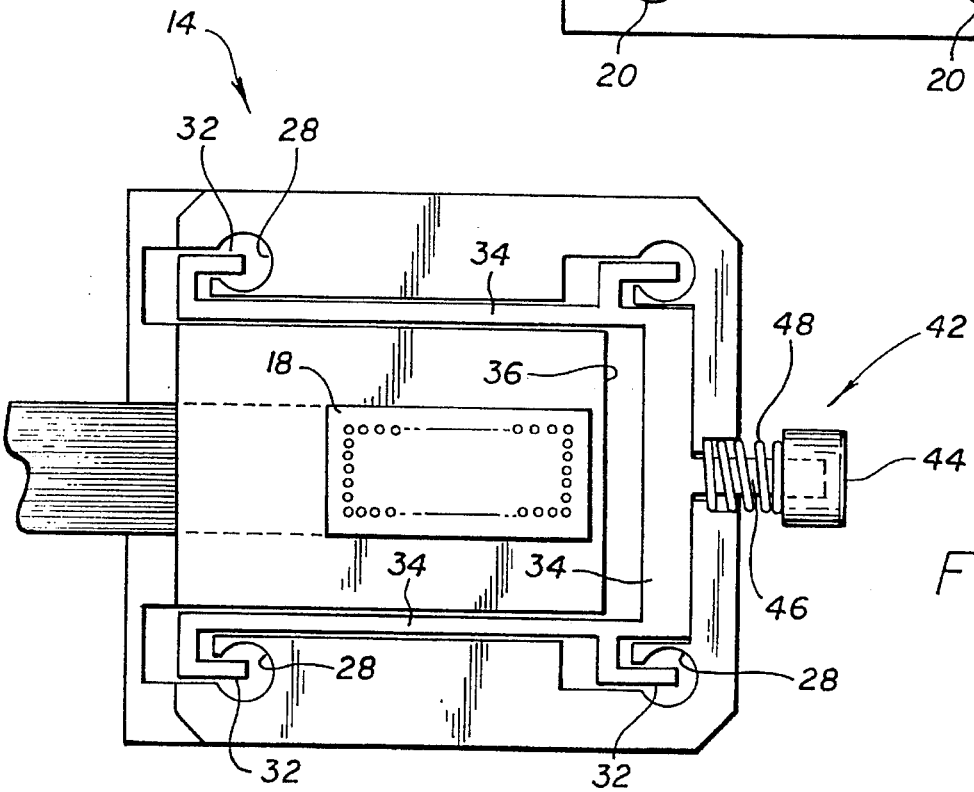
FIG. 2 is a top cross-sectional view of the female connector member of the electrical connector.

Referring to the drawings more particularly by reference numbers, FIGS. 1–4 show an electrical connector 10 of the present invention. The connector 10 has a male connector 12 that is mated to a female connector 14. In the preferred embodiment, the male connector 12 has a plurality of electrical contacts 16 that mate with corresponding electrical contacts 18 of the female connector 14. The contacts can be constructed as pin and socket, gold dot, card edge or any other conventional type of connector contacts. The contacts are typically coupled to wires, or a printed circuit board, and provide a connection between two electrical devices as is known in the art. Although the connectors 12 and 14 are shown and described with electrical contacts, it is to be understood that the locking mechanism of the present invention can be used in other types of assemblies. For example, the connectors 12 and 14 can be attached to garment material.

The male connector 12 has a plurality of male pins 20 that extend from a male base member 22. Each pin 20 has a locking aperture 24 oriented essentially perpendicular to the longitudinal axis of the pin 20. The pins 20 also have an oblique cam surface 26. The male pins 20 are typically constructed as separate components that are subsequently assembled to the male base member 22, although it is to be understood that the male connector 12 can be constructed as one homogenous piece. For example, the male connector 12 may be one piece if constructed from an injection molded plastic.

The female connector 14 has a plurality of alignment apertures 28 located within a female base member 30. Within each alignment aperture 28 is a female pin 32 that is oriented essentially perpendicular to the longitudinal axis of the aperture 28. The female pins 32 have dimensions that correspond to the inner dimensions of the locking apertures 24, so that the pins 32 can slide in and out of the apertures 24. The female pins 32 extend from a chassis 34 located within a channel 36 of the female connector 14. The channel 36 is formed by a cover plate 38 that encloses a groove formed in the base member 30. The chassis 34 can slide within the channel 36 so that the female pins 32 can move between a first position and a second position. The female pins 32 preferably have an oblique cam surface 40.

Extending from the chassis 34 is a handle assembly 42 that allows a user to move the female pins 32 from the first position to the second position. The handle assembly 42 includes a button 44 attached to a shaft 46 that extends from the chassis 34. Adjacent the to button 44 is a spring 48 which also engages the female base member 30. The spring 48 biases the female pins 32 into the first position.

As shown in FIG. 5, when the connector is mated, the male pins 20 are inserted into the alignment apertures 28. The apertures 28 may have countersinks to lead the nose of the male pins 20 into the holes 28. The cam surfaces 26 of the male pins 20 engage the cam surfaces 40 of the female pins 32, so that the female pins 32 are pushed out of the apertures 28 in a lateral direction. In the preferred embodiment, both cam surfaces have 45° angles so that the pins 20 and 32 slide relative to each other in a smooth manner, thereby minimizing the frictional forces between the pins and the overall insertion force of the connector. In the preferred embodiment, the connector 10 is constructed so that the pins 20 and 32 can be locked together with no more than 15 pounds of force.

The male pins 20 are inserted into the alignment apertures 28 until the female pins 32 are aligned with the locking apertures 24. The female pins 32 then slide into the apertures 24 to interlock the pins 20 and 32 and secure the male connector 12 to the female connector 14. To disengage the connectors the user may push the button 44 toward the female base member 30 until the female pins 32 are disengaged from the locking apertures 24. When the button 44 is released, the spring 48 returns the female pins 32 back to the original first position. In the preferred embodiment, the spring 48 is constructed so that the female pins 32 can be pushed out of the male pins 20 with no more than 5 pounds of force.

The male 12 and female 14 connectors can be constructed from either a metal or a plastic material. It is preferable to manufacture the connector from a stainless steel if the members are constructed from metal. In accordance with the teachings of conventional electrical connectors, the members may be constructed to have a plastic dielectric inner core and a metal outer shell. The present invention provides a locking mechanism that is relatively strong and is easy to engage and disengage. The actual strength of the locking mechanism will depend upon the dimensions of the pins 20 and 32 and the type of material. The actual dimensions are typically limited by the design constraints of the connector environment. Although electrical contacts are shown and described, it is to be understood that the connectors 12 and 14 may couple other structures such as a microwave wave guide.

Figure 6:
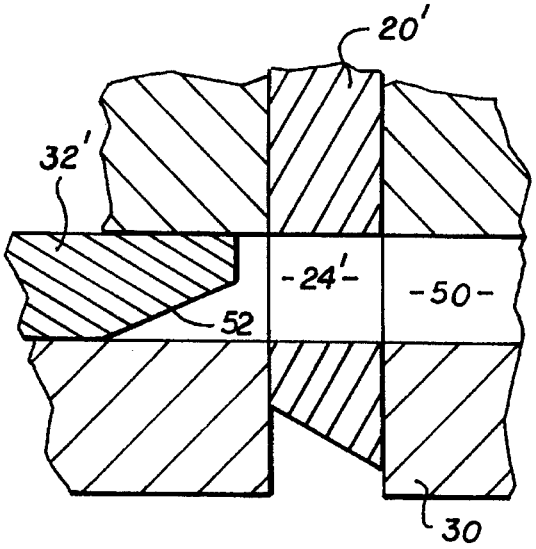
FIG. 6 is a cross-sectional view showing an alternate locking pin embodiment with a female pin disengaged from a male pin.
Figure 7:
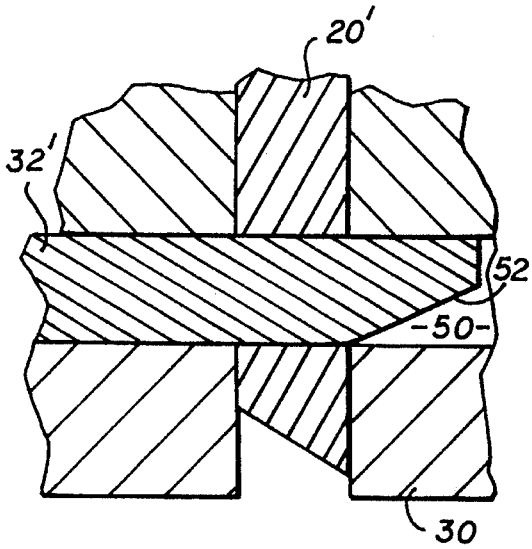
FIG. 7 is a cross-sectional view showing the female pin locked into the male pin.
Figure 8:
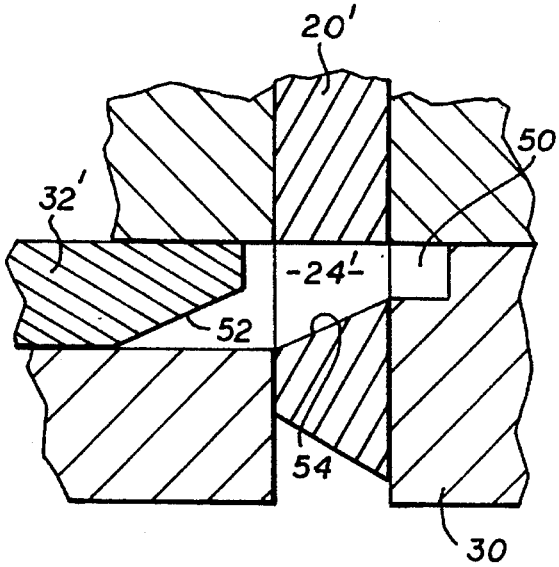
FIG. 8 is a cross-section view similar to FIG. 6 showing a pair of cam surfaces in the interlocking pins.
Figure 9:
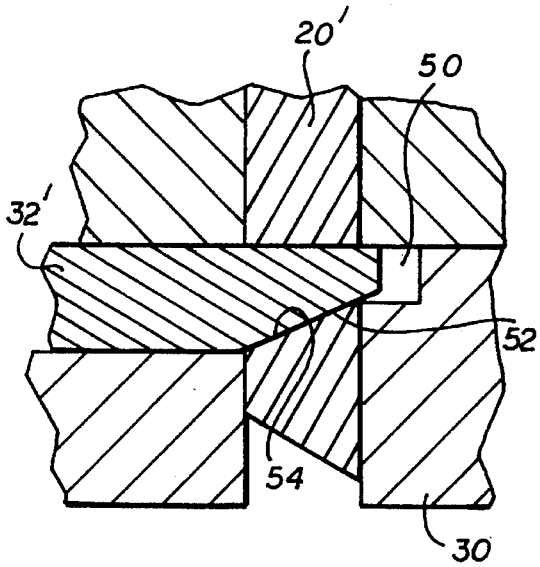
FIG. 9 is a cross-section view similar to FIG. 7 showing the pins of FIG. 8 in an engaged position.

FIGS. 6 and 7 show an alternate embodiment, wherein the female pins 32' extend through the entire length of the apertures 24' in the male pins 20'. The female base member 30 has a plurality of slots 50 that receive the female pins 32' and allow the pins 32' to extend through the apertures. Allowing the pins 32' to extend through the apertures 24' effectively doubles the shear area of the pins 32' and the shear strength of the locking mechanism. As shown in FIGS. 8 and 9, the pins 32' and apertures 24' may have corresponding chamfer cam surfaces 52 and 54. The cam surfaces 52 and 54 lead the pins 32' into the apertures 24'. The chamfer cam surfaces 52 and 54 pull the male pin 20 further into the alignment aperture 28 when the female pin 32 is sliding into the pin aperture 24'. The cam surfaces 52 and 54 also maintain tension between the two pins 20' and 24' when the connectors are mated.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A locking mechanism, comprising:

a male base member;

a male connector that has a plurality of male pins that extend from said male base member, each male pin having a locking aperture;

a female connector that has a plurality of female pins that are coupled to a handle by a chassis that is located within a channel of a female base member, said female pins being capable of moving between a engaged position and non-engaged position, said female base member having a plurality of alignment apertures that contain said female pins and receive said male pins so that said female pins are engaged and moved by said male pins so that said female pins become aligned with said locking apertures and slide through said locking apertures to secure said male base member to said female base member;

said handle includes a button that is coupled to said chassis to simultaneously move said female pins when said button is depressed and;

a spring member that is coupled to said button and said chassis to simultaneously push said female pins into said engaged position when said button is released.

2. The locking mechanism as recited in claim 1, wherein each female pin is essentially perpendicular to said male pin.

3. The locking mechanism as recited in claim 1, wherein each locking aperture has an oblique cam surface that engages a corresponding female pin.

4. The locking mechanism as recited in claim 1, wherein four male pins of said male connector cooperate with four male pins that cooperate with 4 corresponding female pins of said female connector.

5. The locking mechanism as recited in claim 1, wherein said male pins each have an oblique cam surface that engages said female pins.

6. The locking mechanism as recited in claim 5, wherein said female pins each have an oblique cam surface that engages a corresponding male pin.

* * * * *